United States Patent [19]

Givens

[11] Patent Number: 5,056,878

[45] Date of Patent: Oct. 15, 1991

[54] STORAGE APPARATUS AND METHOD

[76] Inventor: Charles S. Givens, 6307 Waterford Blvd., Oklahoma City, Okla. 73118

[21] Appl. No.: 543,358

[22] Filed: Jun. 25, 1990

[51] Int. Cl.[5] ..... A47B 91/00

[52] U.S. Cl. ..... 312/255; 312/325; 312/319

[58] Field of Search ..... 108/111; 312/255, 256, 312/325, 319, 245; 248/188.2, 188.5, 644

[56] References Cited

U.S. PATENT DOCUMENTS

| | | | |
|---|---|---|---|
| 840,493 | 1/1907 | Jackley | 312/325 X |
| 1,013,231 | 1/1912 | Stearns | 312/256 |
| 2,679,444 | 5/1954 | Bennett | 312/255 X |
| 3,055,724 | 9/1962 | Mazure | 312/325 X |
| 4,076,351 | 2/1978 | Wyant | 312/325 X |
| 4,088,365 | 5/1978 | Johnson | 312/255 X |

*Primary Examiner*—Joseph Falk

*Attorney, Agent, or Firm*—Laney, Dougherty, Hessin & Beavers

[57] ABSTRACT

A storage apparatus for support either on a ground surface or from a ceiling surface. The apparatus includes a container portion with a tubular member positioned adjacent to each vertical corner thereof. A leg is telescopingly positioned in each tube. The legs may extend downwardly to the ground surface or, alternatively, may be reversed to extend upwardly to the ceiling surface. The tubes extend above the top of the container portion and below the bottom thereof so that when pluralities of the storage apparatus are stacked, the loading is carried by the tubes. A horizontally folding door assembly is disposed across an opening in the container portion. The door assembly has lips thereon to prevent access to gaps between the door assembly and the container portion and between upper and lower portions of the door assembly. The lower portion of the door assembly is guided as the door is opened and closed, and counterbalancing is provided to assist in opening and closing. The door may be locked in either opened or closed positions. Additional elements such as shelving and support rods may be positioned in the container portion. A method of transportation and installation of the storage apparatus is also disclosed.

41 Claims, 4 Drawing Sheets

STORAGE APPARATUS AND METHOD

BACKGROUND OF THE INVENTION

1. Field Of The Invention

The present invention relates to apparatus and methods for storage, and more particularly, to a secure, weather resistant storage apparatus which may be either floor or ceiling mounted and to a method of installation and use of the apparatus in areas such as vehicle parking places.

2. Description Of The Prior Art

Human beings always have a need for convenient storage space, and one desirable location for storage is adjacent to motor vehicles. Storage is generally not a problem in individual garage areas such as in single family homes, but is generally not available in open parking areas or public garages such as those frequently found in office buildings, apartments and condominiums. Accordingly, there is a need for a relatively small storage device with a flexible and secure design which can be easily located in these kinds of parking areas to provide convenient storage without interferring with the parking of the vehicles. The present invention addresses this need by providing a freestanding or hanging storage apparatus designed for positioning in a parking area while allowing a front or rear portion of the vehicle to extend below a storage container portion of the apparatus.

Storage devices, in general, are well known, and a storage box which may be raised and lowered by a rope on guide rails is disclosed in U.S. Pat. No. 4,060,292 to Medina. This device requires adjacent walls to which the rails may be attached. Another storage device adapted for attaching to a wall is disclosed in U.S. Pat. No. 2,485,496 to Elliott. While providing storage inside a dwelling or cabinet, these devices would not be suitable for use in open parking areas because wall mounting is required and security would be compromised. The present invention which provides a freestanding or hanging storage apparatus avoids this problem because it does not require adjacent walls.

SUMMARY OF THE INVENTION

The storage apparatus of the present invention is designed to be secure and weather resistant, and further, to be readily adaptable for use in areas such as vehicle parking places in apartments, condominiums, offices, or the like, although the apparatus may be positioned virtually anywhere.

The storage apparatus comprises a container portion, leg receiving means on the container portion for defining a leg receiving opening therein, and a leg slidably disposed in the leg receiving opening. The leg is adapted for selective engagement with one of a ground surface and a ceiling surface. The leg receiving means may be characterized by a tubular member extending substantially vertically through the container portion. The tubular member preferably extends above a top panel of the container portion and below a bottom panel of the container portion. The leg may be positioned to extend downwardly from the tubular member for engagement with the ground surface or alternatively positioned to extend upwardly from the tubular member for engagement with the ceiling surface. Thus, the leg may be said to be reversible.

In the preferred embodiment, there is one of said tubular members adjacent to each vertical corner of the container portion, and there is a leg disposed in each of the tubular members. The legs are preferably no greater in length than the tubular members so the legs can be telescoped completely within the tubular members for shipping.

The apparatus further comprises fastening means for fastening the legs in any one of a plurality of positions extending from the container portion or in the retracted, shipping position. The fastening means is preferably disposed inside the container portion so that accessibility thereto is limited. Each leg defines a plurality of holes therealong, and the fastening means is adapted for engaging the leg receiving means and a selected one of said holes in the leg.

The storage apparatus may also be said to comprise a container portion defining a door opening therein, and a horizontally folding door assembly disposed across the door opening and pivotally attached to the container portion. The door assembly preferably comprises an upper portion pivotally attached to a shoulder of the container portion defining an upper edge of the opening and further comprising a lower portion pivotally attached to the upper portion.

A guiding means may be provided for guiding a lower end of the lower portion as the door assembly is opened and closed. In the preferred embodiment, the guiding means comprises a substantially vertical track adjacent to a shoulder of the container portion defining an edge of the opening and further comprising a roller disposed in the track and attached to the lower end of the lower portion of the door assembly. A stop means may be provided for limiting upward movement of the roller in the track. In one embodiment, the stop means is characterized by a pin or bolt extending across the track.

As an additional means for providing security when the door assembly is in the closed position, a pin extends from a bottom edge of the lower portion of the door assembly and is adapted for engaging a hole defined in a shoulder of the container portion defining a lower edge of the opening. Preferably, a plurality of such pins and holes are used.

As another security feature, one of the upper and lower portions of the door assembly has a lip thereon for at least partially covering a gap defined between the upper and lower portions when the door assembly is in the closed position. Further, the door assembly has a side lip thereon for at least partially covering a gap defined between the door assembly and the container portion when the door assembly is in the closed position. In the preferred embodiment, there is a side lip on both sides of both the upper and lower portions of the door assembly.

A sealing means is provided on each of the lips for providing a weather resistant seal when the door assembly is closed.

The apparatus also comprises counterbalancing means for counterbalancing the door assembly as it is opened and closed. In the preferred embodiment, the counterbalancing means comprises a spring having a first end attached to the container portion and a second end, a first pulley attached to the second end of the spring, a second pulley attached to the container portion, and a cable having a first end attached to the container portion and a second end attached to the door assembly. The cable is wrappingly engaged with the first and second pulleys such that tension is maintained on the spring as the door assembly is opened and closed. In the preferred embodiment, the first and second pulleys are double pulleys, but other pulley arrangements may be used.

A locking means may be provided for locking the door assembly in the closed position. Also, another locking means may be provided for locking the door assembly in the open position. The locking means for locking the door in the open position preferably comprises a tab extending from a lower portion of the door assembly and defining a hole therein alignable with another hole defined in the container portion and further comprising a pin removably disposed through the aligned holes.

The present invention may also be said to include a method of installing a storage apparatus having a container portion and a plurality of legs telescopingly received therein. The method comprises the steps of transporting the container to a desired location with the legs substantially fully retracted in the container portion, positioning and supporting the container portion over the desired location in a substantially level configuration, extending the legs from the container portion to an operating position engaging a ground surface or a ceiling surface, and locking the legs in the operating position. The step of supporting the container portion over the desired location may be conducted with a hoist and/or winch, and the method further comprises the step of releasing the winch from the container portion any time after locking of the legs.

The method may also be said to comprise the step of positioning a relatively smaller one of said storage apparatus within the container portion of a relatively larger one of the storage apparatus during transportation thereof to the desired location. Since the leg receiving tubular members extend above and below the container portion, the method may also comprise the step of stacking a plurality of the storage apparatus such that the tubular members of one storage apparatus are engaged with the corresponding tubular members of an adjacent storing apparatus.

An important object of the present invention is to provide a secure and weather resistant storage apparatus which may be selectively mounted on a ground surface or suspended from a ceiling surface.

Another object of the invention is to provide a storage apparatus which may be used in a parking space positioned above the ground surface thereof such that a portion of a vehicle may be positioned under the storage apparatus.

Another object of the invention is to provide a storage apparatus having a container portion with a horizontally folding door which may be used to securely close the container portion.

Still another object of the invention is to provide a method of transporting and installing a storage apparatus.

Numerous objects and advantages of the invention will become apparent as the following detailed description of the preferred embodiments is read in conjunction with the drawings which illustrate such embodiments.

DESCRIPTION OF THE PREFERRED EMBODIMENTS

Figure 1:
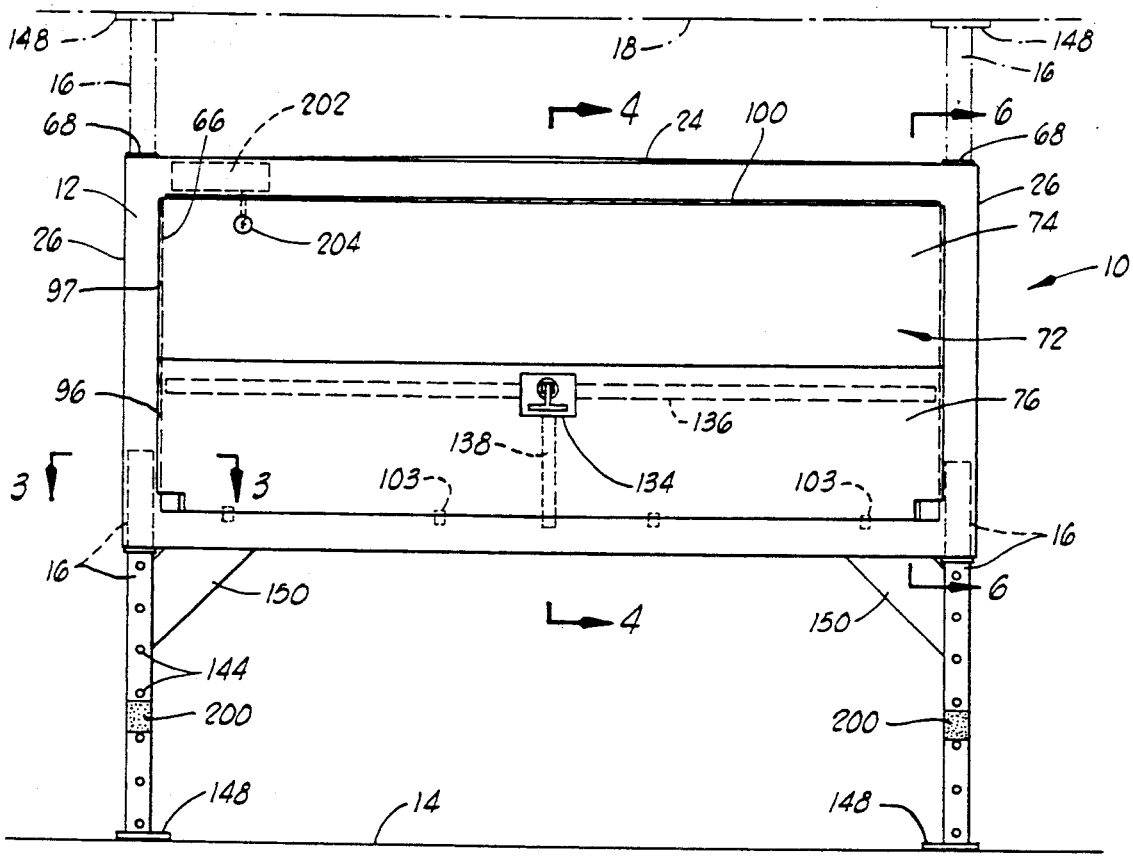
FIG. 1 shows a front elevation view of the storage apparatus of the present invention.
Figure 2:
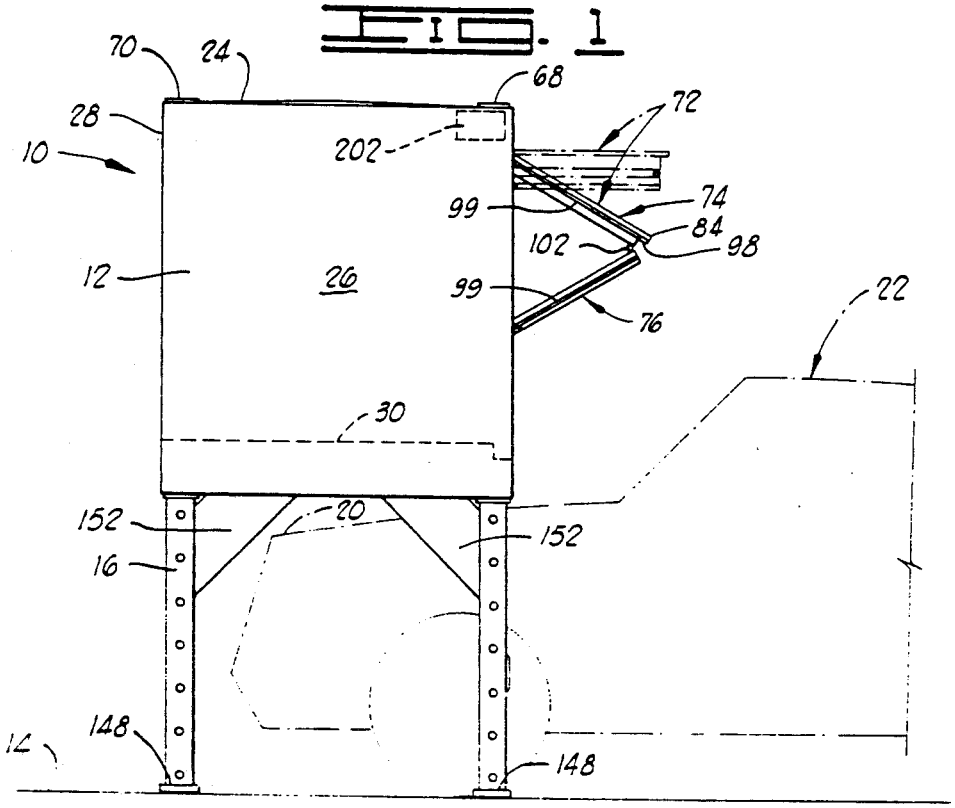
FIG. 2 is an end view of the storage apparatus.

Referring now to the drawings, and more particularly to FIG. 1, a first embodiment of the storage apparatus of the present invention is shown and generally designated by the numeral 10. Generally, apparatus 10 comprises a container portion 12 supported above a ground surface 14 by a plurality of legs 16. Alternatively, legs 16 may be reversed, as further described herein, so that container 12 may be hung from a ceiling surface 18 above ground surface 14. With either mounting configuration, it is preferred that container 12 be spaced above ground surface 14 sufficiently so that a forward or rearward portion 20 of a vehicle 22 may be positioned therebelow as shown in FIG. 2.

Whether container 12 is supported on ground surface 14 or hung from ceiling surface 18, legs 16 are adjustable, as will be further discussed herein, so that container 12 may be leveled to allow for variations in ground surface 14 or ceiling surface 18. For example, ground surface 14 in a parking area may be sloped to allow for drainage. The adjustability of legs 16 provides a means for compensating for this so that container 12 is leveled.

Referring now to FIGS. 1-7, the details of apparatus 10 will be discussed. In the embodiment shown, container 12 has a substantially solid top panel 24, side panels 26, rear panel 28 and bottom panel 30. The panels are preferably sheet metal panels affixed to one another by any means known in the art, such as welding, although other materials and fastening techniques may be used.

Figure 4:
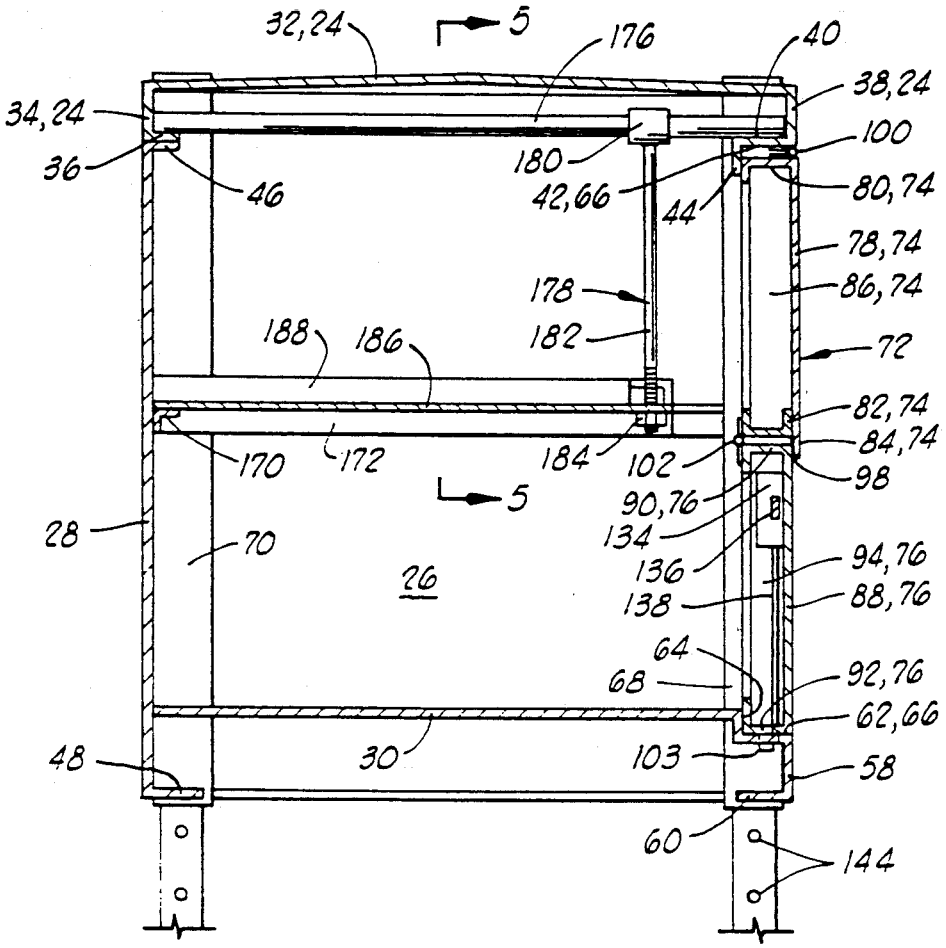
FIG. 4 shows a vertical cross section taken along lines 4—4 in FIG. 1.
Figure 6:
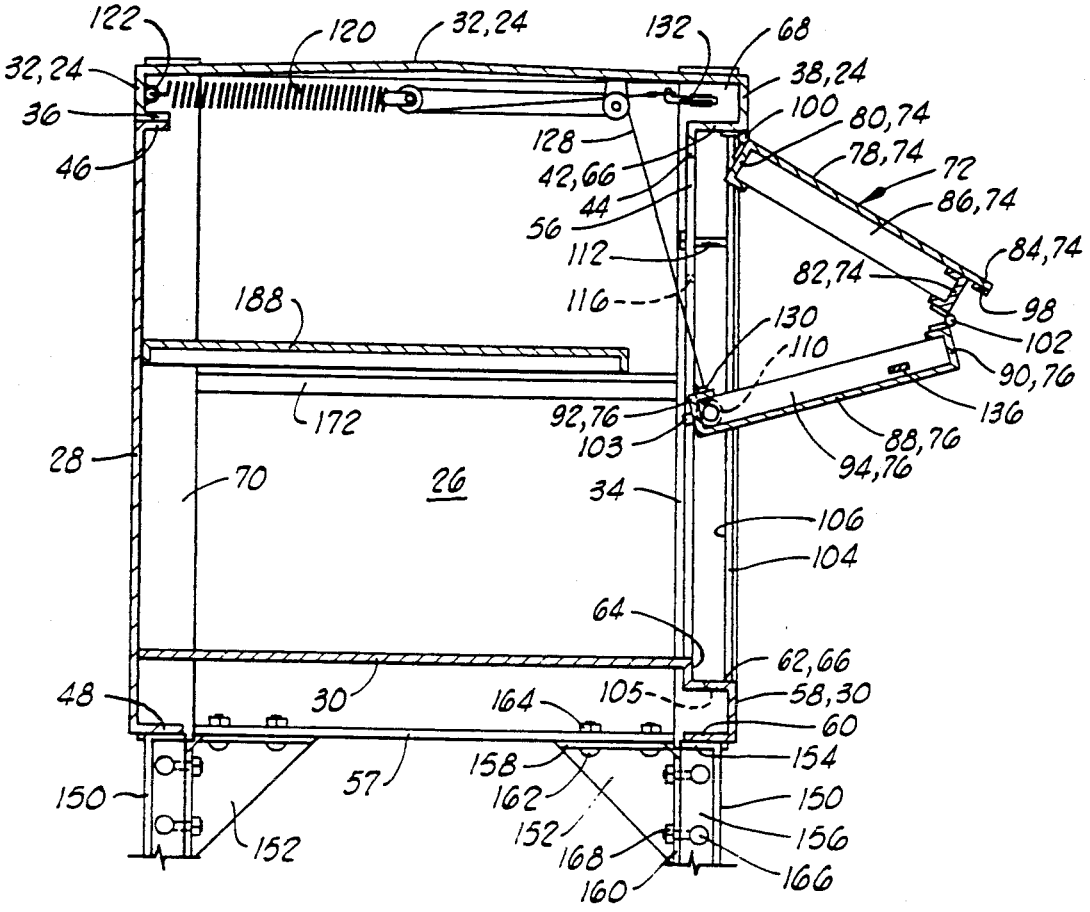
FIG. 6 is another vertical cross section taken along lines 6—6 in FIG. 1.

Referring to FIGS. 4 and 6, top panel 24 is a formed member having an upper portion 32 which is peaked in the center to insure drainage and to prevent the collection of moisture thereon. Top panel 24 has a rear portion 34 which defines an inwardly directed lip 36. Top panel 24 also has a front portion 38 which defines an internal shelf 40 and an external, downwardly facing shoulder 42. A lip 44 extends downwardly from shoulder 42 and shelf 40. Lip 36 is substantially coplanar with shelf 40.

Rear panel 28 is a formed member having an upper lip 46 which is positioned adjacent to lip 36 of top panel 24 and a lower lip 48.

Figure 3:
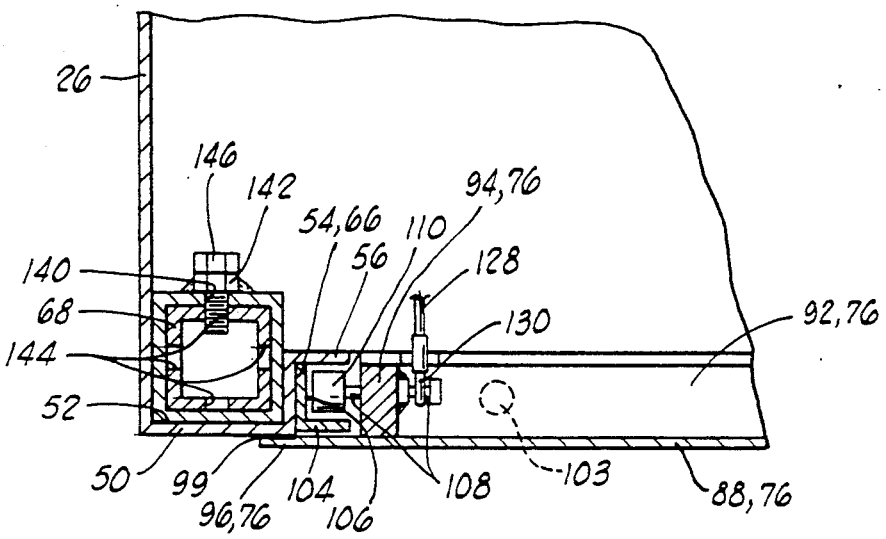
FIG. 3 is a detailed cross section taken along lines 3—3 in FIG. 1.

As best seen in FIG. 3, each side panel 26 is a formed member having a front portion 50 which defines a substantially U-shaped opening or recess 52 therein and has a substantially vertical shoulder 54. A lip 56 extends inwardly from shoulder 54. As seen in FIG. 6, each side panel 26 also has a horizontal side lip 57 which extends inwardly.

Referring again to FIGS. 4 and 6, bottom panel 30 is a formed member having a front portion 58 with a lower lip 60 which is substantially coplanar with lip 48 on rear panel 28. Front portion 58 of lower panel 30 also defines a horizontal shoulder 62 with a vertical shoulder 64 spaced inwardly and extending upwardly therefrom. Vertical shoulder 64 is substantially coplanar with lip 44 of front portion 38 of top panel 24. Also, vertical shoulder 64 and lip 44 are substantially coplanar with lips 56 on front portions 50 of side panels 26. Thus, it may be said that shoulder 42 on top panel 24, shoulders 54 on side panels 26 and shoulder 62 on bottom panel 30 define a substantially rectilinear opening 66 in container 12.

A substantially vertical front tube 68 is positioned in each U-shaped opening 52, formed by side panels 26. Similarly, a substantially vertical rear tube 70 is positioned in each corner formed by the intersection of rear panel 28 with each side panel 26. Front tubes 68 and rear tubes 70 extend through the full height of container 12, and the tops of front tubes 68 and rear tubes 70 are above the peak of top panel 24. The bottom of front tubes 68 extend below lip 60 on bottom panel 30, and similarly, the bottom of rear tubes 70 extend below bottom lip 48 on rear panel 28. The tops of all of the tubes are substantially coplanar, and the bottoms of the tubes are also substantially coplanar. As will be further discussed herein, front tubes 68 and rear tubes 70 are adapted for telescopingly and slidably receiving legs 16 therein.

Referring again also to FIG. 1, disposed in opening 66 in container 12 is an elongated horizontally folding door assembly 72. Door assembly 72 has an upper portion 74 and a lower portion 76.

Referring now to FIGS. 4 and 6, upper door portion 74 has a front panel 78 which is a formed member having a substantially U-shaped channel portion 80 integrally formed at the upper end thereof. A lower channel member 82 is attached to front panel 78 at a position above the lower edge thereof, and channel member 82 generally faces channel portion 80. Because of the positioning of channel member 82, it will be seen that front panel 78 forms a downwardly extending lip on upper door portion 74. An end piece 86 is disposed at opposite longitudinal ends of upper door portion 74.

Lower door portion 76 has a front panel 88 which is a formed member having an upper channel portion 90 and a lower channel portion 92 integrally formed therewith. Upper and lower channel portions 90 and 92 generally face one another.

An end piece 94 is disposed adjacent to longitudinal ends of front panel 88 and spaced inwardly therefrom such that front panel 88 forms a side lip 96 on lower portion 76, as seen in FIGS. 1 and 3. Upper portion 74 of door assembly 72 has a similar side lip 97, identified in FIG. 1. It will be seen that side lips 96 and 97 provide security for storage apparatus 10 by covering the vertical gaps between door assembly 72 and opening 66 in container 12.

Lower door portion 76 is recessed with respect to upper door portion 74 such that the upper end of front panel 88 of the lower door portion is covered by lip 84 of the upper door portion when door assembly 72 is in the closed position shown in FIG. 4. Thus, access to the gap defined between upper door portion 74 and lower door portion 76 is prevented which helps make storage apparatus 10 more secure. A sealing means, such as a piece of weather stripping 98, is attached to the inside of lip 84 and seals against front panel 88 of lower door portion 76 when door assembly 72 is in the closed position. Another sealing means, such as pieces of weather stripping 99, are attached to the inside of lip 96 on lower door portion 76 and the inside of lip 97 on upper door portion 74 on both ends of door assembly 72, as seen in FIGS. 2 and 3. Weather stripping 99 seals against front portions 50 of both side panels 26 of container 12 when door assembly 72 is in the closed position. Weather stripping 98 and 99 are made of an elastomeric material which is sealingly compressed when door assembly 72 is closed.

The upper edge of channel portion 80 of upper door portion 74 is attached to shoulder 42 of container 12 by a horizontal hinge 100. Channel member 82 of upper door portion 74 is attached to channel portion 90 of lower door portion 76 by another horizontal hinge 102. FIG. 4 illustrates door assembly 72 in a closed position, and FIGS. 2 and 6 show door assembly 72 in a partially open position which illustrates the pivotation of hinges 100 and 102. FIG. 2 also illustrates in phantom lines door assembly 72 in a fully open position.

Referring to FIGS. 3, 4 and 6, at least one pin 103 extends from channel portion 92 of lower door portion 76. Pin 103 is adapted for engagement with hole 105 defined through shoulder 62 of lower panel 30 when door assembly 72 is in a closed position. This engagement of pin 103 with hole 105 provides additional security for closed door assembly 72.

Referring to FIGS. 3 and 6, an angle member 104 is disposed adjacent to shoulder 54 and lip 56 of front portion 50 of each side panel 26. Thus, a generally U-shaped vertical track 106 is defined on each side of opening 66 in container 12. Tracks 106 are disposed in opposite directions so that they open toward one another.

A shaft 108 is disposed through the lower end of each end piece 94 of lower door portion 76, and the shaft extends toward the corresponding track 106. Rotatably mounted on shaft 108 is a roller 110 which is thus disposed in the corresponding track 106 and guided thereby. Roller 110 remains in track 106 as door assembly 72 is opened or closed, thus preventing the lower end of lower door portion 76 from swinging outwardly or inwardly with respect to container 12.

Adjacent to an upper end of each track 106 a bolt or pin 112 is disposed across the track to act as a stop means for limiting upward movement of roller 110.

Figure 5:
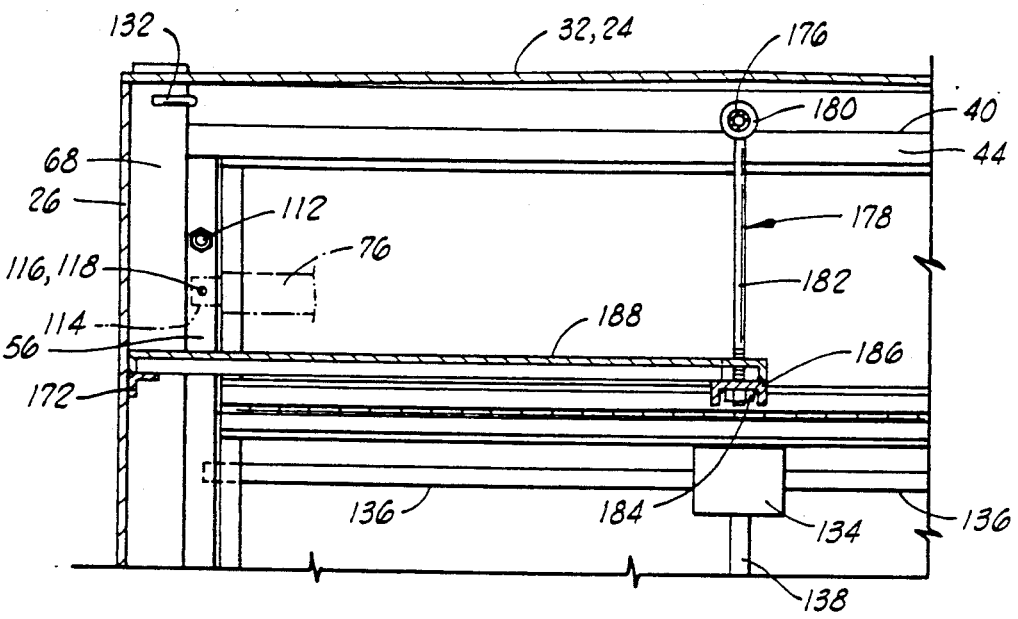
FIG. 5 is a partial cross section taken along lines 5—5 in FIG. 4.

As seen in FIG. 5, a tab 114 extends from the lower end of lower door portion 76 into track 106, and, when door assembly 72 is in its fully open position, tab 114 is aligned with a hole 116 defined in lip 56 adjacent to track 106. Tab 114 has a corresponding hole, and a pin 118 may be inserted through the aligned holes to lock door assembly 72 in the fully open position.

Referring again to FIG. 6, a biasing means, such as spring 120, is attached at a first end to rear portion 34 of top panel 24 at point or bracket 122 adjacent to each rear tube 70. A double pulley 124 is attached to a second, opposite end of spring 120. Another double pulley 126 is attached to top panel 24 of container 12 and spaced forwardly of pulley 124. A cable 128 is attached at one end to a ring or hook 130 engaged with an end of shaft 108 which extends from the opposite side of end piece 94 from roller 110, as best seen in FIG. 3. Still referring to FIG. 6, cable 128 extends from ring 130, is wrappingly engaged with pulleys 124 and 126, and is attached at the other end of the cable to a bracket 132 affixed to the upper end of front tube 68 to preferably maintain tension in spring 120.

It will be seen that when door assembly 72 is in its closed position, the maximum extension is applied to spring 120, and spring 120 will begin to contract as door assembly 72 is opened. When door assembly 72 is in its fully open position, spring 120 has the minimum load applied thereto. Thus, to close door assembly 72, a force must be applied to the door assembly and transmitted through cable 128 to spring 120 sufficiently to overcome the force of the spring before the door can be closed. Also, as door assembly 72 is opened, the energy in extended spring 120 is released so that the spring assists in opening the door. Thus, a counterbalancing means is provided to minimize the force in opening and closing door assembly 72 and to assist in holding the door assembly in its open position.

Now referring to FIGS. 1 and 4, a latching mechanism 134 of a kind known in the art is installed in lower portion 76 of door assembly 72. Latching mechanism 134 has a pair of substantially horizontal latching bars 136 adapted for lockingly engaging opposite holes defined in shoulders 56 of side panels 26 of container 12 and a substantially vertical latching bar 138 adapted for latchingly engaging a hole defined in shoulder 62 of lower panel 30 of container 12. Latching mechanism 134 is also of a kind that may be locked so that when door assembly 72 is closed, container 12 may be secured.

Referring once again to FIGS. 1 and 3, legs 16 are adapted to be slidably received within front tube 68. The construction of rear tube 70 is substantially identical to front tube 68. Tube 68 defines a hole 140 therethrough, and a nut 142 is attached to front tube 68 adjacent to hole 140 and aligned therewith. Hole 140 and nut 142 may be aligned with any one of a plurality of holes 144 in each leg 16. When leg 16 is in the desired relationship with respect to tube 68, a bolt 146 is threadingly engaged with nut 142. Bolt 146 is long enough to extend through holes 140 and 144 to lock leg 16 in place. The locking of leg 16 with respect to rear tubes 70 is substantially identical.

Thus, the height of container 12 may be positioned at any of a plurality of heights above ground surface 14 so that portion 20 of vehicle 22 may be disposed therebelow, as illustrated in FIG. 2 and previously mentioned. Further, different holes 144 in each leg 16 may be used so that a means is provided for compensating for variations in the elevation of ground surface 14. For example, if ground surface 14 tapers downwardly from the rear of container 12 toward the front thereof, legs 16 which extend into rear tubes 70 may be positioned so that they do not extend downwardly as far from container 12 as do legs 16 disposed in front tubes 68. In this way, container 12 may be leveled as necessary.

At the end of each leg 16 opposite container 12 a mounting pad 148 is fixedly attached to the leg. Mounting pad 148 is adapted for attachment, such as by bolting or other means to ground surface 14.

In an alternate embodiment, legs 16 may be reversed with respect to container 12 so that they extend upwardly therefrom, and mounting pads 148 may be attached to ceiling surface 18, if any. In this latter configuration, container 12 is thus hung from ceiling surface 18 rather than supported on ground surface 14. This reversible feature of legs 16 in front tubes 68 and rear tubes 70 thus provides great flexibility in the positioning and mounting of apparatus 10. It will be seen by those skilled in the art that legs 16 may be variably positioned when apparatus 10 is used in the alternate embodiment hung from ceiling surface 18 to compensate for variations in the ceiling surface and to level container 12.

In the preferred embodiment, an additional feature of legs 16 is that they are no longer than the length of front tubes 68 and rear tubes 70. That is, for convenience in shipping, legs 16 may be totally collapsed or telescoped within container 12, except for mounting pads 148. When in this fully collapsed position, bolt 146 may be used to hold the legs in place during shipping. Since tubes 68 and 70 extend above top panel 24 and below lower lips 48 and 60, different units of apparatus 10 may be stacked on top of one another and the load is carried by tubes 68 and 70 rather than being applied to the sheet metal panels. Thus, multiples of apparatus 10 may be transported in a minimum amount of space, and damage to the sheet metal panels thereof during shipping is prevented.

Once legs 16 are in their desired position, strengthening gussets 150 and 152 may be attached to container 12 and legs 16. Referring to FIG. 6, each gusset 150 has a top flange 154 and a side flange 156, and similarly, each gusset 152 has a top flange 158 and a side flange 160. Top flange 158 of gusset 152 is attached to lip 57 of side panel 26 by a fastening means, such as a plurality of bolts 162 and nuts 164. The gusset 150 along the front of container 12 is attached to lip 60 of front portion 58 of lower panel 30 in a similar manner, and gussets 150 on the rear of container 12 are attached to lower lip 48 of rear panel 28 in the same fashion. Side flange 156 of gusset 150 is attached to the adjacent leg 16 and side flange 160 of the corresponding gusset 152 by a plurality of L-bolts 166 and nuts 168. L-bolts 166 extend through a pair of holes 144 perpendicular to one another in the corresponding leg 16. L-bolts 166 are of a kind known in the art, and other fastening means might also be used. When so fastened, gussets 150 and 152 provide strength and stability for apparatus 10.

Referring now to FIGS. 4–6, additional convenience features of storage apparatus 10 will be discussed. Extending along rear panel 28, and at least partially between rear tubes 70, is a bracket 170. A similar bracket 172 extends along each side panel 26 at least a portion of the distance between the corresponding front tube 68 and rear tube 70. Brackets 172 are aligned with bracket 170 such that the top surfaces thereof are substantially coplanar. It will be see by those skilled in the art that a full shelf (not shown) extending the full distance between brackets 172 may be positioned on brackets 172 and 170 and supported thereby in a manner known in the art. Any number of sets of brackets 170 and 172 may be disposed within container 12 so that the shelving may be positioned at a plurality of desired heights.

A support rod 176 may be positioned on lip 36 and aligned shoulder 40 as seen in FIGS. 4 and 5. Rod 176 is shown to have a circular cross section so that it is well adapted for positioning hangers thereon, but other cross-sectional shapes may also be adequate.

In one embodiment, a shelf support assembly 178 may be hung from rod 176. In the embodiment shown, shelf support assembly 178 includes a ring 180 slidably disposed on rod 176 and having an arm 182 attached thereto and extending downwardly therefrom. The lower end of arm 182 is threaded and adapted for engagement by a nut 184. The threaded end of arm 182 extends through one end of a support member 186. The opposite end of member 186 is positioned on bracket 170. Nut 184 is adjusted so that the upper surface of member 186 is substantially aligned with brackets 172. A half shelf 188 ma be positioned on member 186 and brackets 172. Shelf 188 extends approximately one-half the width of container 12, thus providing flexibility in the arrangement of shelving and hanging rods within the container. For example, with one shelf 188 in position, the opposite side of container 12 may be used to store larger items. The object, of course, is to provide the greatest flexibility possible in use of storage apparatus 10.

Figure 7:
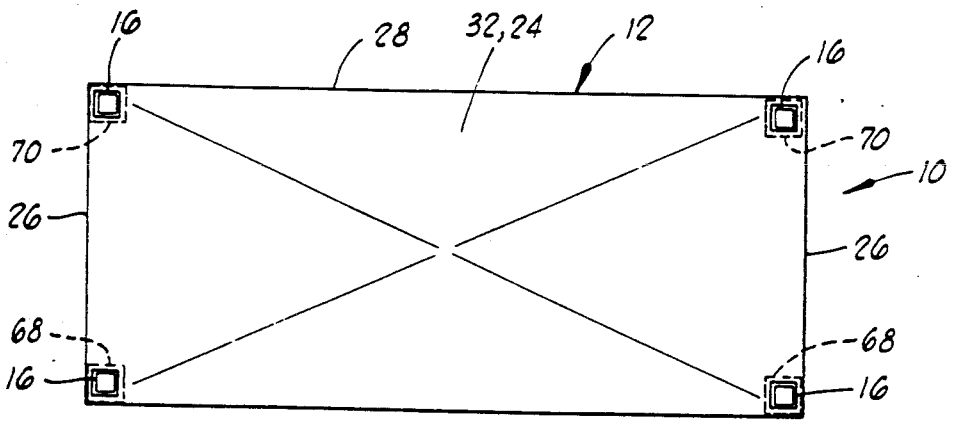
FIG. 7 is a plan view of the embodiment shown in FIGS. 1-6.
Figure 8:
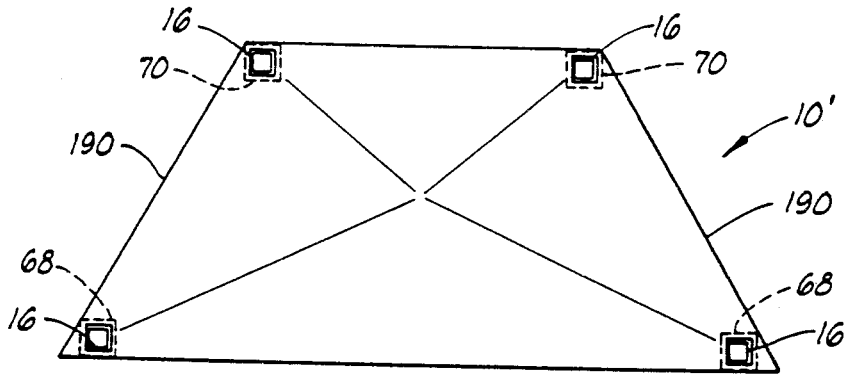
FIG. 8 shows a plan view of an alternate embodiment of the storage apparatus.

As shown in FIG. 7, and as previously discussed, the general configuration of one preferred embodiment of apparatus 10 is substantially rectangular when seen in a plan view. However, the invention is not intended to be limited to this particular geometry. An alternate embodiment of the storage apparatus of the present invention is shown in FIG. 8, and generally designated by the numeral 10'. In this alternate embodiment, apparatus 10' is of substantially trapezoidal shape when seen in a plan view and has angled sides 190. The construction and use of front tubes 68 and rear tubes 70, and their interaction with legs 16, is substantially similar to the first embodiment. Also, the arrangement and construction of door assembly 72 is substantially identical in alternate embodiment 10'. Additional geometric shapes other than the rectangular and trapezoidal ones illustrated may also be used as desired.

Figure 9:
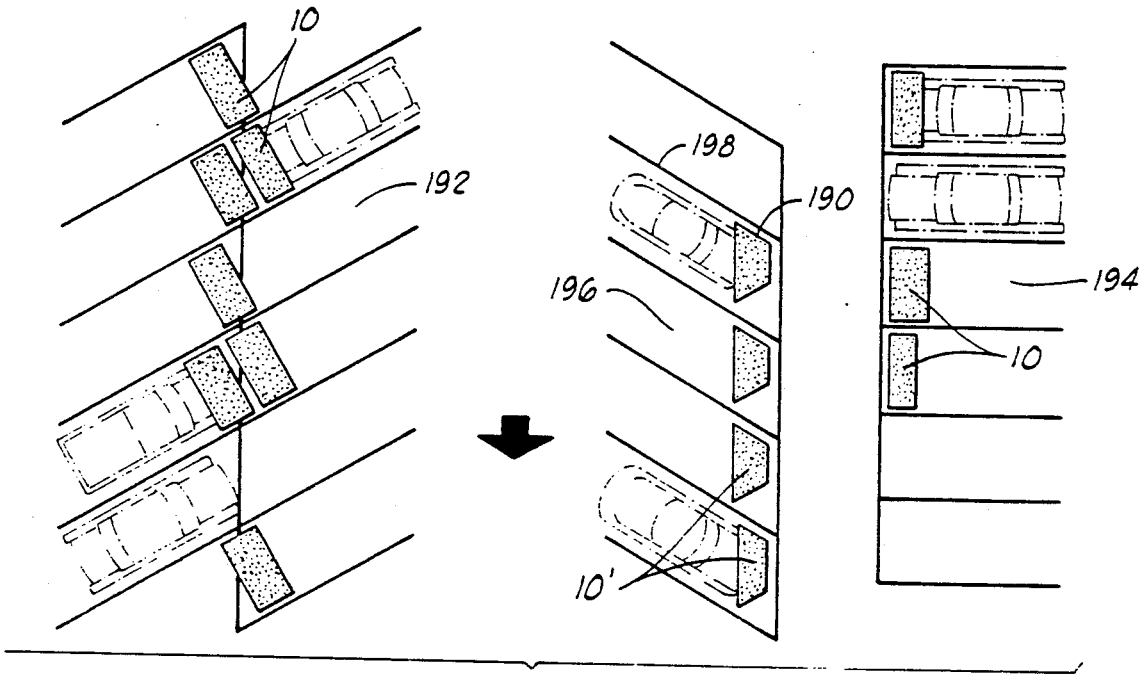
FIG. 9 illustrates the use of the various embodiments in different types of parking locations.

FIG. 9 illustrates the use of first embodiment apparatus 10 and alternate embodiment apparatus 10' in various parking configurations and locations. On the left side of FIG. 9, first embodiment apparatus 10 is shown in use with diagonal parking spaces 192, and the right side of FIG. 9 illustrates apparatus 10 in straight or perpendicular parking spaces 194. Note that different sizes of apparatus 10 may be used. In one preferred embodiment, smaller sizes of apparatus 10 are adapted to fit within larger sizes of the apparatus so that multiple units may be shipped at one time in a "nested" configuration. This adds to the convenience and flexibility of shipping of apparatus 10 as previously discussed.

The center portion of FIG. 9 illustrates second embodiment 10' as used in diagonal parking spaces 196. Preferably, the angle of sides 190 is substantially the same as the angle of lines 198 demarcating parking spaces 196. As with first embodiment 10, alternate embodiment 10' is illustrated in different sizes. These different sizes may also be appropriately sized for nesting within one another for shipping.

A light reflector 200 may be attached to legs 16, as shown in FIG. 1, to assist in making the apparatus visible when a vehicle is parked adjacent thereto at night. Reflectors may also be attached to the front of container 12 as desired.

Referring to FIGS. 1 and 2 an alarm system of a kind known in the art may be positioned inside container 12 in any convenient location. A lockable switch 204 may extend through any panel in container 12, such as upper door portion 74 as seen in FIG. 1, and electrically connected to alarm 202 so that the operator may actuate or deactuate the alarm as desired.

In one method of shipping and installing apparatus 10 or 10', the apparatus is brought in on a truck of a kind known in the art having a hoist and/or winch thereon. Container 12 is lifted by the winch and positioned over the corresponding parking space or other desired locations. Legs 16 are extended downwardly until mounting pads 148 thereof contact floor surface 14, or alternatively, reversed and extended upwardly until mounting pads 148 contact ceiling surface 18. Once positioned, legs 16 are fastened into place and gussets 150 and 152 installed as previously discussed. Any time after legs 16 are locked, the winch is disconnected from the apparatus. Thus, apparatus 10 or 10' are adapted for quick and easy installation.

It will be seen, therefore, that the storage apparatus and method of the present invention is well adapted to carry out the ends and advantages mentioned, as well as those inherent therein. While presently preferred embodiments of the apparatus have been shown for the purposes of this disclosure, numerous changes in the arrangement and construction of parts may be made by those skilled in the art. All such changes are encompassed within the scope and spirit of the appended claims.

What is claimed is:

1. A storage apparatus comprising:
a container portion;
leg receiving means on said container portion for defining a leg receiving opening;
a leg slidably disposed in said leg receiving opening, said leg being adapted for selective engagement with one of a ground surface and a ceiling surface;
a pair of gussets attached to said leg and to said container portion;
an L-shaped bolt engaging said pair of gussets and extending through a portion of said leg; and
a nut threadingly engaged with said L-shaped bolt.

2. The apparatus of claim 1 wherein said leg receiving means comprises a tubular member extending substantially vertically through said container portion.

3. The apparatus of claim 2 wherein said leg may be positioned to extend downwardly from said tubular member for engagement with said ground surface and positioned to extend upwardly from said tubular member for engagement with said ceiling surface.

4. The apparatus of claim 2 wherein:
there is one of said tubular members adjacent to each vertical corner of said container portion; and
there is a leg disposed in each of said tubular members.

5. The apparatus of claim 2 wherein a length of said leg is substantially no greater than a length of said tubular member.

6. The apparatus of claim 2 wherein said tubular member extends above a top panel of said container portion and below a bottom panel of said container portion.

7. The apparatus of claim 1 wherein:
said container portion comprises a panel having a portion defining a substantially U-shaped recess; and
said leg receiving means is characterized by a tube vertically disposed in said recess.

8. The apparatus of claim 7 wherein:
said tube has a substantially square cross section; and
said leg has a substantially square cross section.

9. The apparatus of claim 1 further comprising a door assembly on said container portion for providing access to an interior of said container portion.

10. The apparatus of claim 9 wherein said door assembly comprises:
an upper portion hingedly attached to said container portion; and
a lower portion hingedly attached to said upper portion.

11. The apparatus of claim 10 further comprising means for guiding said lower portion as said door assembly is opened and closed.

12. The apparatus of claim 10 further comprising a lip extending from said door assembly for at least partially covering a gap defined between said door assembly and said container portion when said door assembly is in a closed position.

13. The apparatus of claim 9 further comprising means for counterbalancing said door assembly as said door assembly is moved between open and closed positions.

14. The apparatus of claim 1 wherein said means for engaging and attaching is characterized by a mounting pad on an end of said leg.

15. The apparatus of claim 1 further comprising:
a shoulder in said container portion and forming a part thereof; and
a rod supported on said shoulder.

16. The apparatus of claim 15 further comprising:
a flange attached to said container portion;
a shelf support assembly hanging from said rod; and
a shelf disposed on said flange and said shelf support assembly.

17. A storage apparatus comprising:
a container portion having a substantially trapezoidal cross-sectional shape;
leg receiving means on said container portion for defining a leg receiving opening; and
a leg slidably disposed in said leg receiving opening, said leg being adapted for selective engagement with one of a ground surface and a ceiling surface.

18. The apparatus of claim 12 further comprising fastening means for fastening said leg in one of a plurality of positions extending from said container portion.

19. The apparatus of claim 18 wherein said fastening means is disposed inside said container portion.

20. The apparatus of claim 18 wherein:
said leg defines a plurality of holes therealong; and
said fastening means is adapted for engaging said leg receiving means and a selected one of said holes in said leg.

21. The apparatus of claim 12 further comprising a gusset attached to said leg and to said container portion.

22. A storage apparatus comprising:
a container portion defining a door opening therein;
a horizontally folding door assembly disposed across said door opening and pivotally attached to said container portion, said door assembly comprising:
an upper portion pivotally attached to a shoulder of said container portion defining an upper edge of said opening; and
a lower portion pivotally attached to said upper portion;
guiding means for guiding a lower end of said lower portion as said door assembly is opened and closed, said guiding means comprising:
a substantially vertical track adjacent to a shoulder of said container portion defining an edge of said opening; and
a roller disposed in said track and attached to said lower end of said lower portion; and
stop means for limiting upward movement of said roller in said track.

23. The apparatus of claim 22 wherein said stop means is characterized by a pin extending across said track.

24. The apparatus of claim 22 further comprising a pin extending from a bottom edge of said lower portion of said door assembly, said pin being adapted for engaging a hole, defined in a shoulder of said container portion defining a lower edge of said opening, when said door assembly is in a closed position.

25. The apparatus of claim 22 wherein one of said upper and lower portions of said door assembly has a lip thereon for at least partially covering a gap defined between said upper and lower portions when said door assembly is in a closed position.

26. The apparatus of claim 25 further comprising sealing means on said lip for sealingly engaging the other of said upper and lower portions.

27. The apparatus of claim 22 wherein said door assembly has a lip thereon for at least partially covering a gap defined between said door assembly and said container portion when said door assembly is in a closed position.

28. The apparatus of claim 27 further comprising sealing means on said lip for sealingly engaging said container portion.

29. The apparatus of claim 22 further comprising counterbalancing means for counterbalancing said door assembly as it is opened and closed.

30. The apparatus of claim 29 wherein said counterbalancing means comprises:
a spring having a first end attached to said container portion and a second end;
a first pulley attached to said second end of said spring;
a second pulley attached to said container portion; and
a cable having a first end attached to said container portion and a second end attached to said door assembly, said cable being wrappingly engaged with said first and second pulleys such that tension is maintained on said spring as said door assembly is opened and closed.

31. The apparatus of claim 22 further comprising means for locking said door assembly in a closed position.

32. The apparatus of claim 22 further comprising means for locking said door assembly in an open position.

33. The apparatus of claim 32 wherein said means for locking comprises:
a tab extending from a lower portion of said door assembly and defining a hole therein alignable with another hole defined in said container portion; and
a pin disposable through the aligned holes.

34. The apparatus of claim 22 further comprising:
a substantially vertical tube disposed in said container portion adjacent to each vertical corner thereof; and
a leg telescopingly disposed in each of said tubes.

35. The apparatus of claim 34 further comprising means for locking said legs in an extended operating position with respect to said container portion.

36. The apparatus of claim 34 wherein said legs have a length substantially no greater than a length of said tubes.

37. The apparatus of claim 34 wherein each of said tubes extends above a top panel of said container portion and below a bottom panel of said container portion.

38. The apparatus of claim 22 wherein said container portion has a trapezoidal cross section.

39. A storage apparatus comprising:

a container portion defining a door opening therein;

a horizontally folding door assembly disposed across said door opening and pivotally attached to said container portion;

a rod disposed across an upper interior portion of said container;

a shelf support assembly at least partially hung from said rod; and a shelf at least partially supported by said shelf support assembly.

40. The apparatus of claim 39 wherein said shelf support assembly comprises:

a ring disposed around said rod;

an arm extending downwardly from said ring;

a shelf support member attached to said rod; and means for adjusting a relative height of said shelf support with respect to said rod.

41. A storage apparatus comprising:

a container portion;

leg receiving means on said container portion for defining a leg receiving opening;

a leg slidably disposed in said leg receiving opening, said leg being adapted for selective engagement with one of a ground surface and a ceiling surface;

a shoulder in said container portion;

a rod supported on said shoulder;

a flange attached to said container portion;

a shelf support assembly hanging from said rod, said shelf support assembly comprising:

a ring disposed around said rod;

an arm extending downwardly from said ring; and a substantially horizontal shelf support adjustably attached to said arms; and a shelf disposed on said flange and said shelf support assembly.

* * * * *
* * * * *

UNITED STATES PATENT AND TRADEMARK OFFICE

CERTIFICATE OF CORRECTION

PATENT NO. : 5,056,878

DATED : October 15, 1991

INVENTOR(S) : Charles S. Givens

It is certified that error appears in the above-identified patent and that said Letters Patent is hereby corrected as shown below:

Column 8, line 48, delete "see" and insert --seen-- therefor.

Column 9, line 3, delete "ma" and insert --may-- therefor.

Claim 18, line 1, delete "12" and insert --17-- therefor.

Claim 21, line 1, delete "12" and insert --17-- therefor.

Signed and Sealed this

Twenty-ninth Day of June, 1993

Michael K. Kirk

*Attest:*

MICHAEL K. KIRK

*Attesting Officer*

*Acting Commissioner of Patents and Trademarks*